United States Patent [19]

Bastian

[11] 4,010,909

[45] Mar. 8, 1977

[54] DISPENSING CABINET FOR SHEET MATERIAL

[75] Inventor: Lehyman John Bastian, Media, Pa.

[73] Assignee: Scott Paper Company, Philadelphia, Pa.

[22] Filed: Sept. 15, 1975

[21] Appl. No.: 613,070

[52] U.S. Cl. ..... 242/55.3; 226/91; 242/58

[51] Int. Cl.² ..... A47K 10/38; A47K 10/22; B65H 19/04

[58] Field of Search ..... 242/55.3, 55.53, 58; 312/39; 226/91

[56] References Cited

UNITED STATES PATENTS

| | | | |
|---|---|---|---|
| 3,628,743 | 12/1971 | Bastian | 242/55.3 |
| 3,917,191 | 11/1975 | Graham, Jr. et al. | 242/55.53 |

*Primary Examiner*—George F. Mautz
*Attorney, Agent, or Firm*—Bruce Hart; Martin L. Faigus; William J. Foley

[57] ABSTRACT

Disclosed is a dispensing cabinet for sequentially dispensing material from a primary roll and a reserve roll by passing the sheet material through a nip formed by two rotatably mounted feed rollers. The dispensing cabinet has transfer means and trnasfer actuation means for feeding sheet material from the reserve roll into the nip in response to substantial depletion of sheet material from the primary roll. The transfer means is adapted to press the sheet material from the reserve roll into contact with both of the feed rollers at spaced-apart locations on the sheet material and on the inwardly rotating side of the nip. The transfer means and feed rolles are adapted to drive the reserve roll sheet material towards the nip by the cooperation of the transfer means and one of the feed rollers and to block the reserve roll sheet material from being driven past the transfer means by the cooperation of the transfer means with the other feed roller, whereby the reserve roll sheet material is crowded into the nip.

5 Claims, 3 Drawing Figures

DISPENSING CABINET FOR SHEET MATERIAL

BACKGROUND OF THE INVENTION

1. Field of the Invention

The present invention relates to dispensing cabinets for sheet material and, more particularly, to a dispensing cabinet which sequentially dispenses sheet material from a primary roll and a reserve roll held within the cabinet. The invention is particularly useful for dispensing paper towels.

2. Brief Description of the Prior Art

In the past, dispensing cabinets have been designed to dispense two rolls of sheet material, such as paper towels, sequentially so that upon the depletion of sheet material from one of the rolls, the unwinding of the second roll was commenced. The past dispensing cabinets have typically included a pair of feed rollers through which the sheet material is passed. The feed rollers are attached to crank arms, either directly or through a gearing arrangement, which are used to crank out the portion of sheet material to be used. Initially, sheet material from the primary roll was placed through the nip of the feed rollers and upon depletion of the primary roll, the leading end of the sheet material from the reserve roll was transferred into the nip formed by the feed rollers.

The dispensing mechanisms of typical prior art dispensing cabinets have not been completely reliable, especially where unwinding of the second roll was to be commenced. This often caused problems since the failure of the second roll to unwind resulted in unavailability of sheet material until the dispensing cabinet received service, which of course, frustrates the very purpose of a two-roll cabinet since the rolls are sequentially dispensed to allow greater time intervals between servicing.

Examples of prior art cabinets in which the leading end of the reserve roll is transferred into the feed rollers upon depletion of the primary roll are described in U.S. Pat. Nos. 2,930,664 to Liebisch; 3,007,650 to Burton; 3,126,234 to Batlas et al; 3,288,387 to Craven, Jr.; and 3,628,743 to Bastian. The dispenser disclosed in U.S. Pat. No. 3,628,743 to Bastian has been proven to be particularly satisfactory for certain uses. It includes a rotatably mounted transfer roller which is movable against one of the feed rollers, the one which is driven, in response to substantial depletion of the sheet material on the primary roll. The leading end of the sheet material from the reserve roll is positioned between the transfer roller and the feed roller while the primary roll is being used, but upon movement of the transfer roller towards the feed rollers the sheet material from the reserve roll is pressed against the driven roller. The driven feed roller, upon being turned by an attached crank handle, then advances the reserve roll sheet material towards the feed roller nip. At the same time, a prong holding the end of the reserve roll sheet material prevents advancement of the sheet material past the feed rollers and thereby forces it to crowd into the feed roller nip.

The principle shortcoming of the dispensing cabinet described in U.S. Pat. No. 3,628,743 is that it requires the driven feed roller, with which the transfer roller engages, to be on the reserve roll side of the feed roller nip. Other cabinet design considerations in combination with the requirement to employ crank handles which turn in the conventional direction places restrictions upon the driving arrangements which can be provided between the crank handle and the feed rollers. For example, the above-described cabinet has been restricted generally to use with reversing gears to cause the driven feed roller to turn in the direction opposite to that of the crank handle. While it is possible to reverse the position of the driven feed roller so that it is on the side of the nip opposite the position of the reserve roll, there will then be a tendency to crank the leading end of the reserve roll sheet material past the feed roller nip and transfer roller without the required crowding to force the sheet material into the nip because there will not be the blocking action provided by the prong.

Accordingly, it is a principal object and advantage of the present invention to provide a new and improved dispensing cabinet for sequentially dispensing sheet material from first and second rolls of spirally wound sheet material in a reliable manner.

It is a still further object and advantage of the present invention to provide an improved mechanism in a dispensing cabinet for automatically commencing the feeding of sheet material from a second roll upon depletion of sheet material from a first roll in a manner which permits either feed roller to be driven.

SUMMARY OF THE INVENTION

These and other objects are satisfied in the dispensing cabinet of the invention, which sequentially dispenses sheet material from a primary roll and a reserve roll by passing the sheet material through a nip formed by two rotatably mounted feed rollers one being driven and one being a pressure roller. The dispensing cabinet includes transfer means for automatically and reliably feeding the sheet material from the reserve roll into the nip upon substantial depletion of sheet material from the primary roll in a manner which permits either feed roller to be the driven one. The dispensing cabinet of the invention also includes transfer actuation means for causing the transfer means to engage the feed rollers in response to substantial depletion of the sheet material in the primary roll. The transfer means is adapted to press the reserve roll sheet material into contact with both feed rollers at spaced-apart locations on the sheet material and on the inwardly rotating side of the nip when the transfer means engages the feed rollers. The feed rollers and the transfer means are adapted to drive the reserve roll sheet material towards the nip by the cooperation of the transfer means with the driven feed roller, and the two are further adapted to block the reserve roll sheet material from being driven past the transfer means by the cooperation of the transfer means with the pressure feed roller, whereby the reserve roll sheet material is crowded into the nip.

In a preferred form of the invention the feed rollers are provided by a driven roller and by a pressure roller which has a lower surface coefficient of friction than the driven roller. The transfer means is provided by two separate transfer rollers, each being rotatably mounted for movement into engagement with a different feed roller. And, preferably, the transfer roller which engages the pressure roller is mounted for movement into engagement with the pressure roller before engagement of the other transfer roller with the driven roller to assure blocking of the sheet material before it can be driven beyond the transfer means.

DESCRIPTION OF THE PREFERRED EMBODIMENTS

Figure 1:
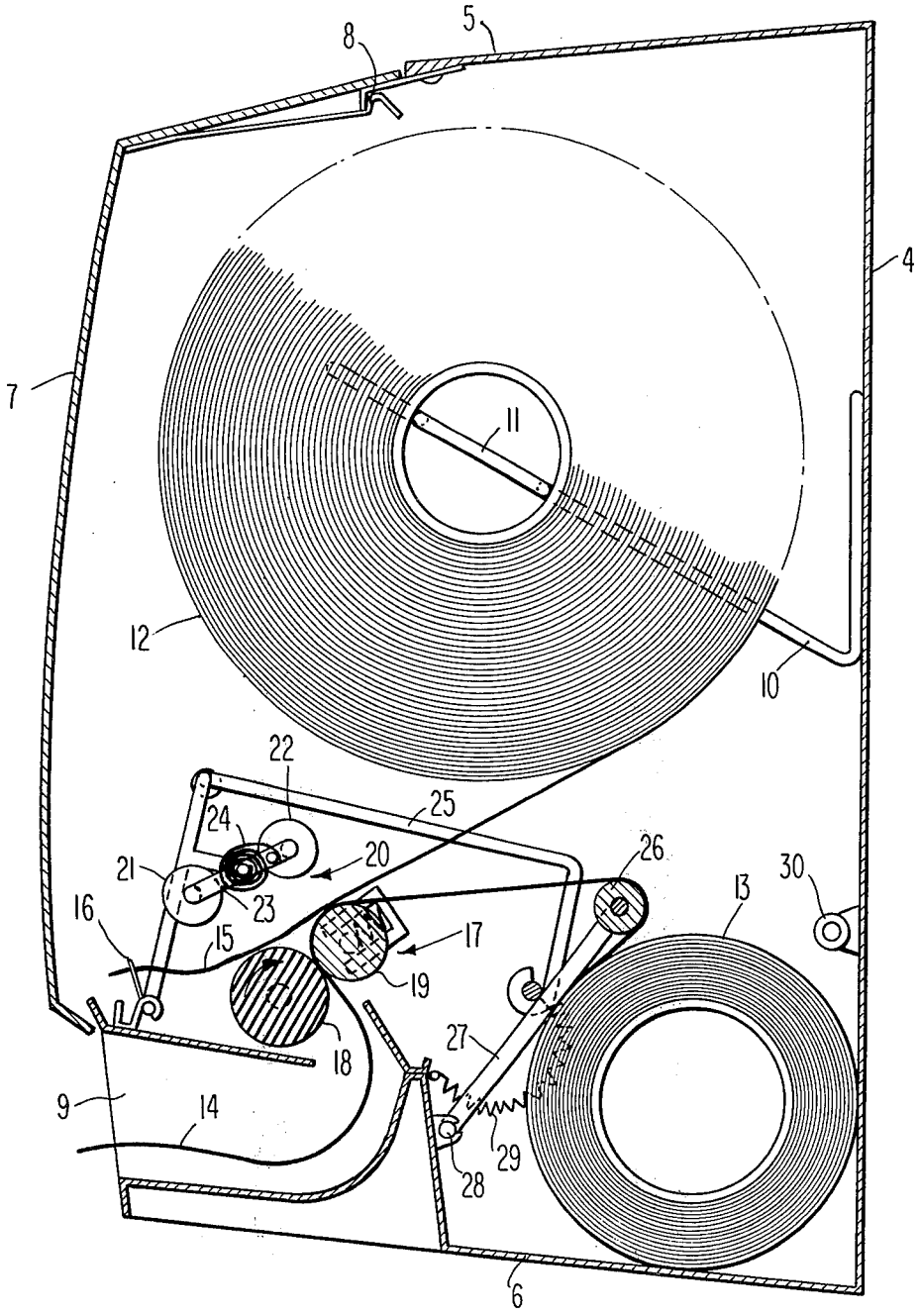
FIG. 1 is a sectional side elevation view of the dispensing cabinet of the invention.

Referring to FIG. 1, the dispensing cabinet of the invention includes a housing having a rear wall 4, top wall 5, bottom wall 6, spaced-apart side walls (not shown), and a hinged front wall or door 7 which provides convenient access to the cabinet so that rolls of sheet material can be inserted therein. Fastener means for the door 7 are provided in the form of a spring detent 8 attached to the upper portion of door 7, which cooperates with the downwardly depending front lip in the top wall 5 to secure the door 7 in its closed position. The cabinet may be mounted for use on a wall or other vertical supporting surface or it may be supported on a horizontal surface for use.

The bottom wall 6 of housing includes a generally horizontal rear portion extending from the rear wall 4 to an upwardly depending central portion which connects to an arcuate portion extending downwardly and outwardly and terminating in a downwardly depending lip. The upper surface of the arcuate portion is smooth and forms one wall of an arcuate dispensing passageway 9 which terminates in a dispensing opening. The other wall of dispensing passageway 9 is formed by a plate extending transversely between the side walls and rearwardly from the lower edge of door 7 to a point spaced from the arcuate portion of bottom wall 6.

Two rolls, 12 and 13, of spirally wound sheet material are disposed in the dispensing cabinet in a spaced-apart and a generally parallel relationship. The lower roll 13 is the primary roll of sheet material, which may be either a completely fresh or a partially used roll, and it is disposed in a position where it rests upon and slidingly contacts the bottom wall 6. It also slidingly contacts the rear wall 4 of the cabinet. If the surfaces of these walls are smooth, it has been found that primary roll 13 can be easily unwound and that no means are necessary for rotatably supporting the core. Alternatively, however, the roll 13 may be mounted on rotatable means such as inwardly extending trunnions 31, illustrated in FIG. 3, secured to the rear wall 4 through attachment means 32. In the arrangement illustrated in FIG. 1 where primary roll 13 is unsupported within the cabinet, primary roll 13 will have a tendency to climb rear wall 4 when the sheet material is unwound from it. Stop member 30 therefore is positioned on rear wall 4 above primary roll 13 to restrict upward movement of primary roll 13. Stop member 30 preferably consists of a rotatably mounted roller.

Sheet material from the primary roll 13 is fed over follower means 26 into feed means, indicated generally by reference numeral 17. Feed means 17 comprises two parallel, rotatably mounted rollers 18 and 19 arranged to form a nip through which sheet material is drawn to be dispensed from the cabinet by way of dispensing passageway 9. Feed means 17 includes a driven roller 18 having its axis in a fixed position and a pressure roller 19 having its axis movable towards and away from the axis of driven roller 18. The ends of pressure roller 19 are of reduced diameter and are carried in brackets which house coil springs that exert a force on the ends of pressure roller 19 to press it against driven roller 18.

The upper roll 12 is the reserve roll of sheet material and is a complete roll to be drawn from upon depletion of primary roll 13. It is rotatably supported on spaced-apart wire brackets 10 having inwardly depending portions 11 adapted to project inwardly into the ends of the roll core upon which the sheet material is wound so as to rotatably support the roll 12 thereon. The wire brackets 10 are affixed to the rear wall 4 of the dispensing cabinet. The leading end of the sheet material running from the reserve roll 12 is preferably engaged by engagement means such as the prong 16 located near the front of the cabinet and upon which the reserve roll sheet material 15 is impaled. Although prong 16 is not required, it is helpful to insure that the initially unwound length of sheet material 15 from reserve roll 12 will be held in a desired position until it is fed into the feed means 17 and dispensed as hereinafter described.

Included within the cabinet in a position close to feed means 17 is transfer means 20 which is employed to cause the leading end of the reserve roll sheet material 15 to be fed into the nip formed by feed means 17. Transfer means 20 includes first transfer roller 21 and second transfer roller 22, both rotatably mounted at opposing ends of a linkage member 23 on axes parallel to the axes of the feed rollers 18 and 19. Biasing means provided by a coil spring 24 biases second transfer roller 22 towards feed means 17 for reasons which will be explained subsequently. Linkage member 23 interconnecting first and second transfer rollers 21 and 22 is itself pivotably mounted to a pivotable assembly of members 25 which permit movement of transfer means 20 towards and away from feed means 17. Assembly 25 includes a generally upstanding member pivotably mounted at the front of the cabinet and a generally horizontal member pivotably mounted to the upstanding member and to sheet material sensing member 27 which itself is pivotably mounted at a fixed position 28 on the upwardly depending central portion of bottom wall 6. Assembly 25 is thus arranged to cause transfer means 20 to move in response to movement of sheet material sensing member 27.

At one end of sheet material sensing member 27 is a roller 26 over which the primary roll sheet material 14 passes before entering feed means 17. A spring 29 is attached to sheet material sensing member 27 for urging it towards primary roll 13. Upon substantial depletion of the sheet material on primary roll 13, sheet material sensing member 27 will have moved far enough to cause transfer means 20 to engage feed rollers 18 and 19 with the leading end of reserve roll sheet material 15 in between, causing it to be fed into feed means 17.

Figure 2:
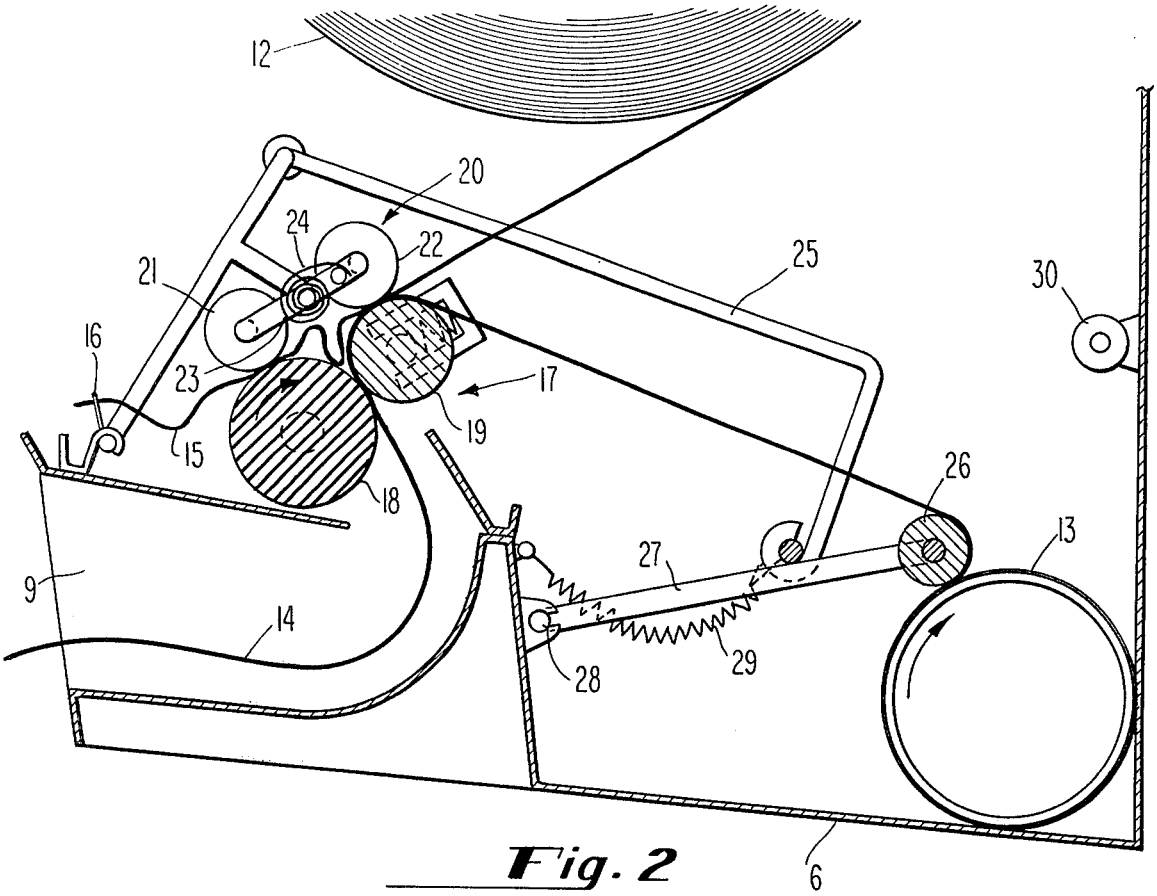
FIG. 2 is a partial sectional side elevation view taken from FIG. 1, illustrating the manner in which the transfer means operates to commence the dispensing of sheet material from the reserve roll.

FIG. 2 illustrates the transfer of reserve roll sheet material 15 into feed means 17. When the sheet material 14 has been substantially depleted from primary roll 13, sheet material sensing member 27 will have rotated clockwise sufficiently to advance transfer means 20 into engagement with feed means 17. The second transfer roller 22 will press a portion of reserve roll sheet material 15 against pressure roller 19 and first transfer roller 21 will press another portion, spaced from the first portion, of reserve roll sheet material 15 against driven feed roller 18. Driven feed roller 18 is connected to a conventional crank arm (not shown) which rotates it in a conventional manner, causing the reserve roll sheet material 15 to be driven towards the nip formed by feed rollers 18 and 19 by the cooperation of first transfer roller 21 and driven feed roller 18. At the same time, second transfer roller 22, pressing against pressure roller 19, blocks the reserve roll sheet material 15 and prevents it from being driven beyond the transfer means 20. Thus, the reserve roll sheet material 15 folds between first transfer roller 21 and second transfer roller 22 and is crowded into the nip formed by driven feed roller 18 and pressure roller 19, where it is gripped between feed rollers 18 and 19 and forced through the feed means 17.

Driven roller 18 preferably has a surface with a greater coefficient of friction than the surface of pressure roller 19. For example, driven roller 18 could have a rubber sleeve forming its surface while pressure roller 19 could be made of wood. In order to assure that the reserve roll sheet material 15 is not driven back beyond the transfer means 20 and feed means 17 before it can be crowded into feed means 17, the blocking action of second transfer roller 22 against pressure roller 19 is required. It is not necessary that reserve roll sheet material 15 be driven towards the nip by pressure roller 19 in order to block the sheet material, although this may happen to some extent due to driven roller 18 rotating. It is only necessary that transfer means 20 press the reserve roll sheet material against pressure roller 19.

As previously described, it is preferable that second transfer roller 22 be biased towards feed means 17 so that it will perform its blocking function in cooperation with pressure roller 19 before, or at least no later, than engagement of first transfer roller 21 with driven roller 18. It is for this purpose that coil spring 24 is provided to bias second transfer roller 22 slightly ahead of first transfer roller 21. Otherwise, slight misadjustment could cause engagement of first transfer roller 21 before that of second transfer roller 22, and the sheet material 15 could be driven from the transfer means 17 without crowding it into the nip.

Figure 3:
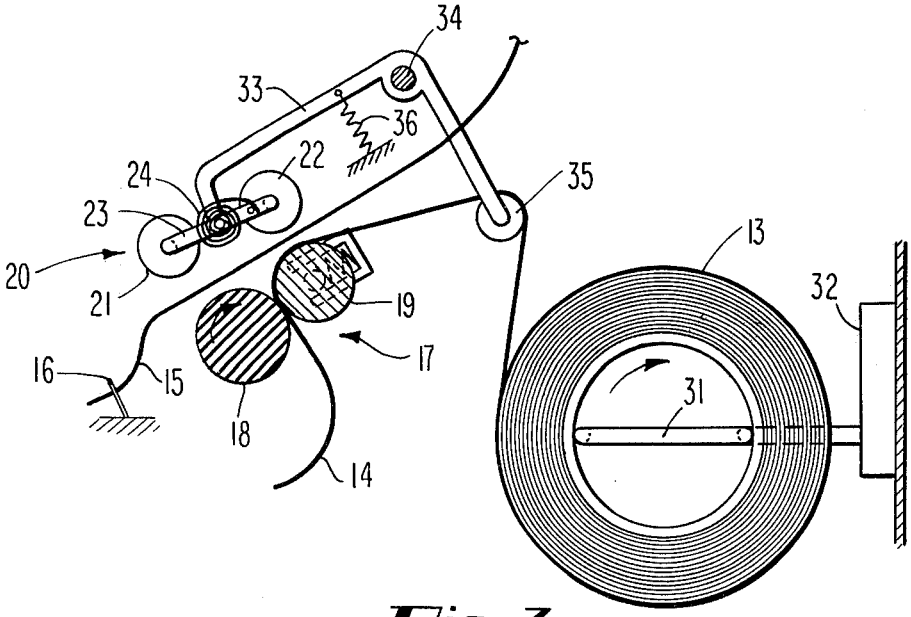
FIG. 3 is a partial sectional side elevation view of the dispensing cabinet of the invention, schematically illustrating another embodiment of the invention.

FIG. 3 illustrates an alternative embodiment of the invention wherein the transfer actuation means for moving transfer means 20 into engagement with feed means 17 is provided by an arrangement different from that shown in FIGS. 1 and 2. In particular, assembly 25 of FIGS. 1 and 2 is replaced with an L shaped arm 33, which is pivotably mounted in a fixed position to the cabinet at pivot means 34. Linkage member 23 of the transfer means 20 is pivotably mounted to one end of L shaped arm 33 at one end, and a rotatably mounted roller 35 is mounted at the other end. Spring 36 is attached to L shaped arm 33 for urging transfer means 20 towards engagement with feed means 17. Sheet material 14 from primary roll 13 passes over roller 35 and holds L shaped arm 33 against the urging of spring 36 to prevent engagement of transfer means 20 with feed means 17. However, as soon as the sheet material 14 from primary roll 13 is substantially depleted L shaped arm 33 is free to respond to the urging of spring 36 and causes transfer means 20 to engage the feed means 17.

In the alternative embodiment illustrated in FIG. 3, a certain amount of tension is necessary in the primary roll sheet material 14 to hold pivot arm 33 against the urging force of spring 36. Accordingly, the loose placement arrangement of primary roll 13 illustrated in FIGS. 1 and 2 are not satisfactory. Primary roll 13 is prefereably mounted through wire bracket 31 which is mounted at 32 to the rear wall 4 of the cabinet. Wire bracket 31 has inwardly projecting portions which bridge across the core of primary roll 13 and exert enough drag to maintain tension in sheet material 14 when it is pulled forward by feed means 17.

Having described the preferred embodiment of the invention, it should be apparent to those skilled in the art that a number of variations can be employed within the scope of the invention. For example, engagement prong 16 is not necessary for satisfactory operation, it being only a desirable feature to assure positioning of the leading end of reserve roll sheet material 15. However, in many applications, the leading end of reserve roll sheet material 15 will tend to remain in the proper position without use of prong 16. Additionally, other embodiments of transfer means 20 could be employed. For example, the transfer means does not necessarily have to include rotatable rollers for engagement with the feed means. The transfer means could be provided by smooth surface means which will permit the sheet material to be driven towards the nip by the driven roller 18 and which will block the sheet material against the pressure roller 19. It is also necessary that the portion of the surface means which blocks the sheet material against the pressure roller 19 permit the sheet material to pass therebetween after it has been gripped in the nip. It should be apparent that the invention will work satisfactorily with either feed roller being the driven roller. A number of arrangements could be thought of which would be satisfactory, although less satisfactory than the described preferred embodiments, it only being necessary that they perform the described functions.

Having described the invention, I claim:

1. In a dispensing cabinet for sequentially dispensing sheet material from a primary roll and a reserve roll, comprising first and second feed rollers rotatably mounted to form a nip through which sheet material is passed to dispense it from the cabinet, drive means for rotating the first feed roller, transfer means for feeding sheet material from the reserve roll into the nip upon engagement of the transfer means with the feed rollers, and transfer actuation means for causing the transfer means to engage the feed rollers in response to substantial depletion of the sheet material in the primary roll, the improvement wherein:

the transfer means comprises first and second rotatably mounted transfer rollers, each being mounted for movement into engagement with a different feed roller for pressing the reserve roll sheet material into contact with both feed rollers at spaced-apart locations on the sheet material and on the inwardly rotating side of the nip when the transfer rollers engage the feed rollers; and the feed rollers and the transfer rollers being adapted to drive the reserve roll sheet material towards the nip by the cooperation of the first transfer roller with the first feed roller and being adapted to block the reserve roll sheet material from being driven past the transfer means by the cooperation of the second transfer roller with the second feed roller, whereby the reserve roll sheet material is crowded into the nip upon engagement of the transfer rollers with the feed rollers and rotation of the first feed roll.

2. The transfer means according to claim 1, wherein the feed rollers are provided by a driven roller and by a pressure roller which has a lower surface coefficient of friction than the driven roller, and the transfer roller which engages the pressure roller is mounted for movement into engagement with the pressure roller before engagement with the driven roller by the other transfer roller.

3. The transfer means according to claim 2, including spring biasing means for urging the transfer roller which engages the pressure roller into engagement with the pressure roller before the other transfer roller engages the driven roller.

4. The transfer means according to claim 1, wherein the transfer actuation means is provided by a sheet material sensing member operably connected to the transfer means and adapted to engage the surface of the primary roll and to move in response to changes in the diameter of the primary roll resulting from unwinding the sheet material therefrom.

5. The transfer means according to claim 1, wherein the transfer actuation means comprises:

a pivotably mounted arm operably connected to the transfer means and adapted to engage the sheet material from the primary roll at a position between the primary roll and the nip; and biasing means for urging the arm against the sheet material, whereby the arm moves upon the depletion of the sheet material on the primary roll and causes the transfer means to engage the feed rollers.

* * * * *